US005704127A

United States Patent [19]

Cordio

[11] Patent Number: 5,704,127

[45] Date of Patent: Jan. 6, 1998

[54] CONCAVE, CONVEX SAFETY RAZORS

[76] Inventor: Caroline Cordio, 818 Misty Cove #296, Arlington, Tex. 76013

[21] Appl. No.: 609,948

[22] Filed: Mar. 4, 1996

[51] Int. Cl.[6] ..... B26B 21/14

[52] U.S. Cl. ..... 30/49; 30/526; 30/529

[58] Field of Search ..... 30/49, 85, 87, 30/89, 90, 346.55, 346.57, 526, 529, 527; 16/115; 15/144.3, 144.4

[56] References Cited

U.S. PATENT DOCUMENTS

| | | | |
|---|---|---|---|
| 1,000,235 | 8/1911 | Carreras | 30/89 |
| 1,961,132 | 6/1934 | Behrman | 30/49 |
| 2,841,425 | 7/1958 | Oeters | 16/115 |
| 4,524,484 | 6/1985 | Graham | 16/115 |
| 4,905,372 | 3/1990 | Willis | 30/85 |
| 4,926,553 | 5/1990 | Miskin et al. | 30/89 |
| 4,976,028 | 12/1990 | Chen | 30/49 |
| 5,167,069 | 12/1992 | Quinn | 30/89 |

*Primary Examiner*—Hwei-Siu Payer
*Attorney, Agent, or Firm*—Martin Sachs

[57] ABSTRACT

A concave, convex safety razor with an extensible handle includes a safety razor blade housing having a concave cutting surface on one end and a convex cutting surface on the other end, that includes a removable and rotatable device disposed on the housing. An elongated handle cooperates with the removable and rotatable device disposed on the housing permitting rotation of the safety razor blade housing and removal and replacement thereof. A hollow extensible handle is adapted to be affixed to the safety razor handle and is capable of extending the length thereof.

3 Claims, 2 Drawing Sheets

CONCAVE, CONVEX SAFETY RAZORS

BACKGROUND OF THE INVENTION

1. Field of the Invention

This invention relates to shaving devices, and more specifically, to safety razors having a concave and convex cutting surface with an extensible handle therefor.

2. Background of the Invention

Many safety razor devices have been devised to enable persons to remove hair from body surfaces that are concave or convex, particularly that disclosed in U.S. Pat. No. 4,993,154 issued to Radcliffe on Feb. 19, 1991 that includes a handle having a bifurcated expansion device that is capable of flexing the razor blade so that it may form a concave or convex cutting surface.

Another device is disclosed in U.S. Pat. No. 5,199,173 issued to Hegemann, et al on Apr. 6, 1993 which provides for a pre-shaped safety razor having both a concave and convex body surface that may be rotated with a knob on the handle.

Yet another device is disclosed in U.S. Pat. No. 5,208,982 issued to Ferruzza, Jr. on May 11, 1993 which provides for a safety razor that flexes the razor blade into a concave position when inserted into the head of the razor.

After reviewing the disadvantages of the devices disclosed in the prior art there appears to be one common shortcoming, which is the inability to reach all the places on the human body that an individual wishes to shave.

SUMMARY OF THE INVENTION

The present invention overcomes the shortcomings found in the prior art by providing a user-selectable convex, concave mode of operation capable of being used on various parts of the human body with the user readily being able to select the type of cutting blade desired. The cutting blade may readily be replaced by the user thereof and with the aid of an extensible handle associated therewith is ideally suitable for persons unable to reach the area to be shaved.

Thus, by utilizing the apparatus set forth in the present invention, a person may readily reach areas of his or her person that would normally be inaccessible with a conventional safety razor blade.

Therefore, it is the object of the present invention to provide a safety razor suitable for use on either concave or convex surfaces.

It is another object of the present invention to provide a safety razor which has a concave, convex cutting surface which is selectable by the user thereof.

Still yet another object of the present invention to provide a safety razor which has a concave, convex cutting surface that may readily be replaced and/or exchanged when desired.

It is still yet another object of the present invention to provide a safety razor blade having a convex, concave cutting surface with an extensible handle to reach distant surfaces to be shaven by the user thereof.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
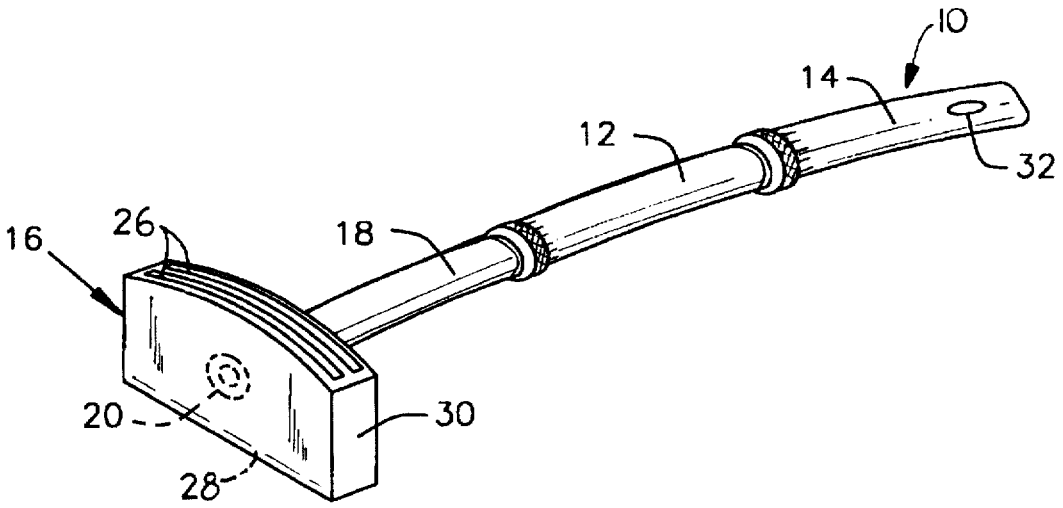
FIG. 1 is a perspective view of the convex, concave safety razor having an extensible handle, according to the principles of the present invention.
Figure 2:
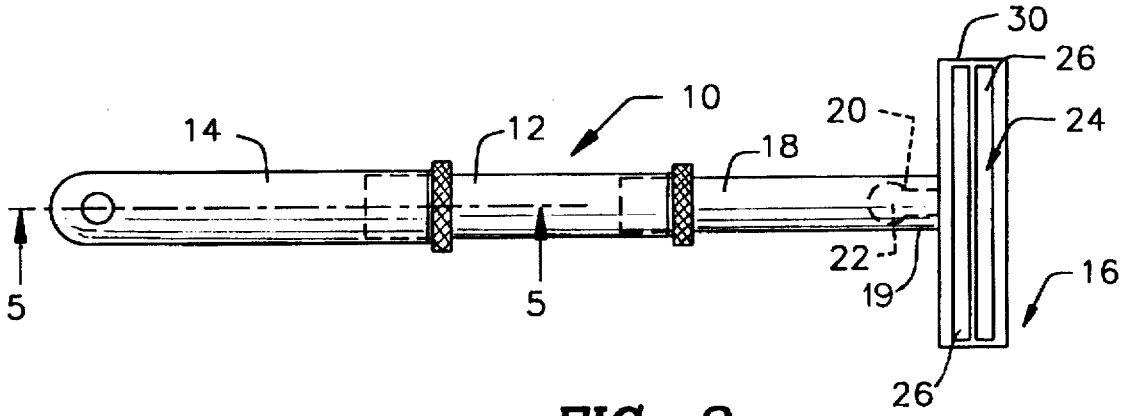
FIG. 2 is a top plan view of the safety razor shown in FIG. 1.
Figure 3:
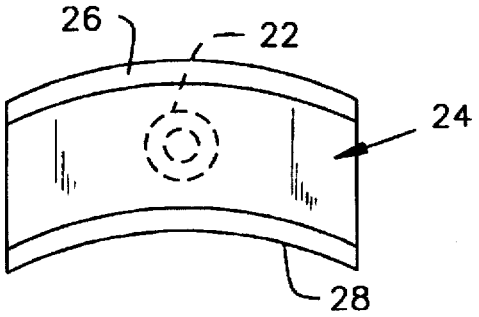
FIG. 3 is an enlarged view in elevation of the razor blade having a concave and convex cutting edge prior to being encased within a plastic housing.
Figure 4:
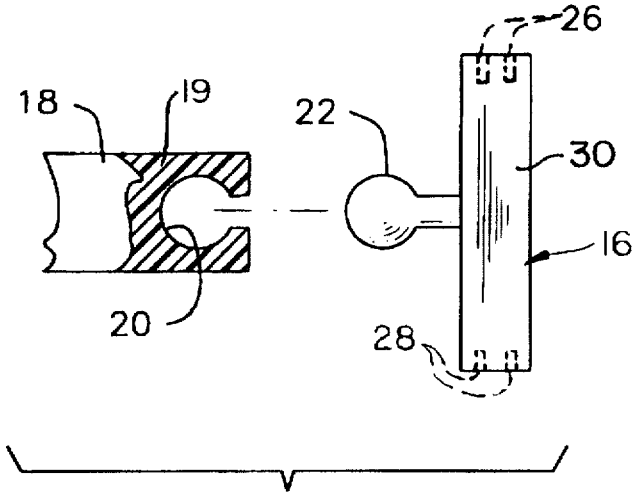
FIG. 4 is a partial perspective end view in elevation of the razor blade and handle connecting device.

Referring now to the Figures, and in particular to FIGS. 1 and 2, there is shown a concave, convex safety razor 10, according to the principles of the present invention. The safety razor 10 is seen to include an extensible handle, which includes sections 12 and 14, and a safety razor blade housing 16 removably attached to a razor handle 18, on one end 19. The other end of razor handle 18 is adapted to be received into the handle section 12 on other end 38 (See FIG. 5). The housing end 19 of the razor handle 18 is preferably provided with a receptacle or socket 20 adapted to receive a bulbus portion 22 shown more clearly in FIG. 4.

The bulbus portion 22 is adapted to be received into the receptacle or socket 20 provided in the razor handle 18 so that with a relatively small amount of pulling force it may be separated therefrom.

The razor housing 16 includes at least one razor blade 24 and is provided with a convex, cutting edge 26 and a concave cutting edge 28 in addition to the bulbus portion 22 which may be welded thereon. Alternatively, the bulbus portion 22 may be provided on the plastic portion 30 of the housing 16 into which the razor blade 24 may be embedded.

Figure 5:
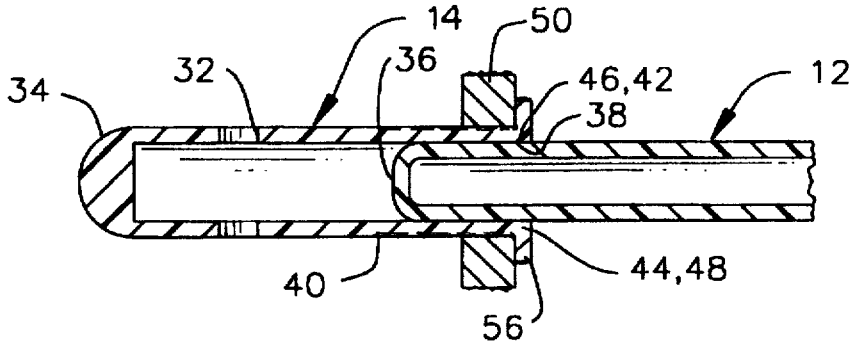
FIG. 5 is a view taken along the line 5—5 of FIG. 2.

Referring now to FIG. 5, which is a cross-sectional view of the extensible handle taken along the line 5—5 of FIG. 2, wherein one is able to view the handle section 14 of the razor blade having an extensible handle 10. A through aperture 32 is provided in the handle section 14 for the purpose of mounting the razor 10 in a convenient place, when not in use for example in a shower or elsewhere. One end 34 of the handle section 14 is preferably solid wherein the remainder of the handle section 14, as well as the handle section 12 is hollow and provided with closed or solid ends 34 and 36, respectively.

Figure 6:
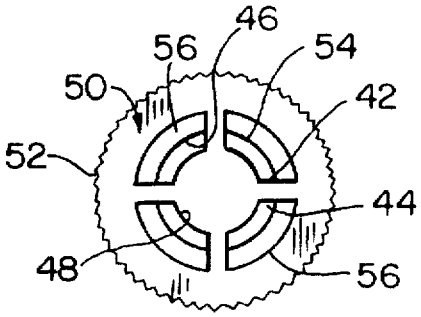
FIG. 6 is an end view in elevation of the last section of the extensible handle prior to insertion of another section therein.

The other or open end 38 of handle section 14 is provided with an externally threaded portion 40, which is cut to form a plurality of fingers 42, 44, 46 and 48, shown more clearly in FIG. 6, that are permitted to flex so that an internally threaded nut 50, having an externally knurled surface 52 provided thereon, may be placed over the open end 38 of handle section 14. The nut 50 has an internal diameter 54 slightly smaller than the external diameter of the handle section 12 so that when handle section 12 is inserted into the open end 38 of handle section 14 it may readily fit therein as long as the nut 50 is threaded away from the open end 38. As the nut 38 is threaded (moved) toward the protruding bead portions 56 provided proximate the distal end 38 of the handle section 14 the nut 50 will not fall off. However, as the nut approaches the protruding bead portion 56 it is retained on the handle section 14 and firmly presses down on the handle section 12 thereby holding it in position. This position of course may be adjusted depending on the user's desire so that the length of the extensible handle may be adjusted to a suitable length for the user. Preferably the extensible handle sections 12 and 14 are similar and provided with a slight curvature so that the extensible handle will be more convenient for the user.

It is also to be noted that the extensible handle sections 12 and/or 14 may be adapted to readily have multiple sections, not shown, inserted therein. The extensible handle, sections 12 and 14 as disclosed herein, may be readily be utilized for a concave, convex safety razor as disclosed herein, as well as, a conventional straight razor.

Hereinbefore has been disclosed a concave, convex safety razor with an extensible handle having a plurality of sections. It will be understood that various changes in the details, materials, arrangement of parts and operating conditions which have been herein described and illustrated in order to explain the nature of the invention may be made by those skilled in the art within the principles and scope of the instant invention.

Having thus set forth the nature of the invention, what is claimed is:

1. A concave, convex safety razor comprising:

A. a safety razor blade housing having;

a) a razor blade with a concave cutting edge and a convex cutting edge disposed within said razor blade housing, and b) one portion of a removable and rotatable means disposed on said housing;

B. a handle having a first end and a second end;

a) means disposed on said handle first end adapted to receive and cooperate with said portion of said removable and rotatable means disposed on said housing for removably retaining said safety razor blade housing and permitting rotation of said housing; and C. hollow extensible means adapted to receive said handle second end therein and extend essentially the length of said handle, said hollow extensible means having;

a) a threaded first end cut to form a plurality of flexible fingers, the distal end of said fingers being provided with a retaining means, said threaded first end being adapted to receive said handle, and b) threaded nut means for locking said handle therein adapted to cooperate with said threaded flexible fingers and be retained thereon by said retaining means.

2. A concave, convex safety razor according to claim 1, wherein said hollow extensible means has at least two sections with the total length of said extensible means being adjustable by a user thereof.

3. A concave, convex safety razor comprising:

A. a razor blade housing with an elongated handle removably affixed thereto;

B. hollow extensible means adapted to receive one end of said elongated handle extending the length of said elongated handle, said extensible means includes;

a) a threaded first end cut to form a plurality of flexible fingers, the distal end of said fingers being provided with a retaining means thereon, said threaded first end being adapted to receive one end of said elongated handle, and b) threaded nut means for locking said one end of said elongated handle therein by cooperating with said threaded flexible fingers and be retainer thereon by said retaining means.

* * * * *